US006896597B2

(12) United States Patent
Dore

(10) Patent No.: US 6,896,597 B2
(45) Date of Patent: May 24, 2005

(54) ABRASIVE BLASTING APPARATUS

(75) Inventor: David James Dore, Derbyshire (GB)

(73) Assignee: Quill International Industries, PLC, Derbyshire (GB)

( * ) Notice: Subject to any disclaimer, the term of this patent is extended or adjusted under 35 U.S.C. 154(b) by 0 days.

(21) Appl. No.: 10/495,823

(22) PCT Filed: Nov. 1, 2002

(86) PCT No.: PCT/GB02/04967

§ 371 (c)(1),
(2), (4) Date: Sep. 7, 2004

(87) PCT Pub. No.: WO03/045633

PCT Pub. Date: Jun. 5, 2003

(65) Prior Publication Data

US 2005/0003747 A1 Jan. 6, 2005

(30) Foreign Application Priority Data

Nov. 22, 2001 (GB) ..... 0127956

(51) Int. Cl.[7] ..... B24C 3/06; B24C 7/00
(52) U.S. Cl. ..... 451/91; 451/99
(58) Field of Search ..... 451/91, 92, 90, 451/99, 101, 102

(56) References Cited

U.S. PATENT DOCUMENTS

| | | | | |
|---|---|---|---|---|
| 2,982,582 A | | 5/1961 | Tilney | |
| 3,849,057 A | | 11/1974 | Garrison et al. | |
| 4,330,968 A | | 5/1982 | Kobayashi et al. | |
| 5,545,074 A | * | 8/1996 | Jacobs | 451/40 |
| 5,637,029 A | | 6/1997 | Lehane | |
| 6,036,584 A | * | 3/2000 | Swinkels et al. | 451/75 |
| 6,726,549 B2 | * | 4/2004 | Rivir et al. | 451/99 |
| 6,827,637 B2 | * | 12/2004 | Lewin et al. | 451/75 |

FOREIGN PATENT DOCUMENTS

| | | |
|---|---|---|
| DE | 43 35 382 A | 4/1995 |
| EP | 1 034 891 A | 9/2000 |
| GB | 0 602 330 A | 5/1948 |
| GB | 1 230 345 A | 4/1971 |
| WO | WO 88 07915 A | 10/1988 |
| WO | WO 00 51787 A | 9/2000 |

* cited by examiner

*Primary Examiner*—Jacob K. Ackun, Jr.
(74) *Attorney, Agent, or Firm*—Harrison & Egbert

(57) ABSTRACT

A blasting apparatus includes a pressure vessel adapted to contain a particulate blasting medium and a liquid. The vessel includes an inlet and a bottom outlet. The interior of the vessel communicates via its bottom outlet with an opening in a conduit along which conduit an entraining pressurized gas can be fed from a pressurizing gas source. A pressurizing device is provided to pump liquid from a liquid source into the vessel behind its contents in terms of its contents' outflow from the vessel through the bottom outlet. A valve is provided to control the flow of pressurized gas along the conduit. Immediately upstream of the opening in the conduit is located a venturi so that the velocity of the pressurized gas is increased as it passes over the opening thereby increasing the quantity of particulate blasting medium entrained by the gas.

11 Claims, 5 Drawing Sheets

ABRASIVE BLASTING APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to an abrasive blasting apparatus and in particular to a dustless abrasive blasting apparatus.

BACKGROUND OF THE INVENTION

In dustless abrasive blasting, an abrasive is entrained in a pressurized liquid flow or gaseous-entrained liquid flow and is directed against the surface to be treated by a controllable nozzle. It is the intention of such apparatus to coat each particle of the abrasive with the liquid so that the abrasive is weighted by the liquid and falls safely to the ground after striking the surface to be blasted, generally obviating the requirement for the operator of the apparatus to wear breathing apparatus. The weighted abrasive also increases the efficiency of the blasting operation.

Typically, the liquid used in abrasive blasting apparatus is water or a water based blasting solution, such as a rust inhibiting solution but it will be appreciated that any suitable liquid could be used. Hence, whenever the term "water" is referred to herein and in the claims it should be understood that the term includes all suitable blasting liquids. Similarly, the pressurized gaseous streams used in blasting operations are typically pressurized air but again the term "air" when referred to herein and in the claims is to be understood as including any gas suitable for use in abrasive blasting operations.

Conventionally, a dry abrasive is entrained into a gaseous stream and liquid is then added to wet the abrasive prior to its egress from the nozzle. In this way, dust generation at the work area is reduced. Such an arrangement, however, requires a separate pump to be used to deliver the liquid into the abrasive and gaseous stream, which makes the cost of the blasting apparatus more expensive than is desirable and renders the blasting apparatus more prone to breakdown.

In WO 88/07916, an apparatus is described which overcomes the aforementioned problems by entraining separately contained liquid and an abrasive/liquid mixture in a flow of pressurized fluid whilst simultaneously applying the pressurized fluid to the receptacles containing the liquid and the abrasive/liquid medium in order to balance the fluid pressure between the receptacles themselves and the receptacles and the delivery line. This has the advantage of requiring only a single pressurized fluid source and therefore of reducing the cost of the apparatus.

The aforementioned apparatus was further refined in WO 00/51787 by the injection of a pressurized fluid into the lower portion of the receptacle directly into the contents, which is thereby agitated. A control means is then provided to control the pressure within the receptacle to ensure that during blasting the pressure of the pressurized fluid entering the vessel through the injection means is always maintained at a higher level than the pressure of the pressurized fluid directed into the vessel by the pressurizing means. This enabled fine abrasive particles in addition to conventional abrasive materials such as various sands and grit, to be used in the apparatus.

However, the aforementioned apparatus all suffer from the disadvantage that a considerable quantity of water or other blasting liquid is used during a blasting operation. This makes the operation messy as large quantities of liquid must be disposed of and the object of the cleaning operation is thoroughly wetted, which can be disadvantageous.

Other apparatus entrain an abrasive/liquid mixture contained in a pressure vessel directly in a flow of pressurized air, the vessel being pressurized by water from a mains supply rather than by pressurized air.

This significantly reduces the quantities of waste water which is produced. However, this apparatus also suffers from the disadvantage that the entrained abrasive particles tend not to be evenly dispersed within the pressurized blasting fluid but clumped together in groups or pockets so that the resulting jet of blasting fluid is not uniform in nature. This slows down a blast cleaning operation as the operator must ensure that the blasting jet is played over the surface to be cleaned for a sufficient length of time to compensate for the unevenness of the jet.

The object of the present invention is to overcome the aforementioned disadvantages by considerably increasing the quantity of abrasive entrained in the pressurized fluid. This has the effect of increasing the ratio of abrasive to blasting liquid content, thus reducing the large quantities of liquid waste which results from a blasting operation. Also, the blasting jet is made more uniform and smooth in nature.

BRIEF SUMMARY OF THE INVENTION

According to the present invention there is provided a blasting apparatus comprising a blasting apparatus comprising a pressure vessel adapted to contain a particulate blasting medium and a liquid and including an inlet and a bottom outlet; a conduit along which an entraining pressurized gas can be fed from a pressurizing gas source and with which the interior of the vessel communicates via an opening in the conduit connected to the outlet, the flow of pressurized fluid through the conduit entraining the contents of the vessel for dispersal into the fluid flow for blasting through a delivery line connected to the conduit; a pressurizing means to pump liquid from a liquid source into the vessel behind its contents in terms of its contents' outflow from the vessel through the bottom outlet; valve means to control the flow of pressurized gas along the conduit; and characterised in that a venturi is located in the conduit immediately upstream of the opening connected to the bottom outlet of the vessel so that the velocity of the pressurized gas is increased as it passes over the opening thereby to increase the quantity of particulate blasting medium entrained by the gas.

Preferably, the outlet from the pressure vessel communicates directly with the delivery line via a pipe which terminates in the opening.

Preferably also, the opening and the venturi respectively comprise inlet ports into a block which forms a part of the conduit, the block defining an outlet for the flow of pressurized gas and entrained media in a side directly opposite the venturi.

Preferably also, the opening is defined by the lowermost side of the block.

Preferably also, the opening comprises a valve opening which can be obturated by a valve member to close off the supply of particulate blasting medium and liquid from the vessel into the conduit. Advantageously, the block houses the valve member.

Preferably also, the valve member comprises a plunger around which pressurized gas in the conduit can flow.

Advantageously, means are provided to inject liquid into the pipe to clear any blockage therefrom.

Preferably, the wall of the lower portion of the vessel defines a shallow dish to encourage flow of the particulate material through the bottom outlet.

Preferably also, the valve means comprises an actuator which is powered by the pressurizing gas.

Preferably also, the apparatus comprises a gas reservoir to ensure that there is sufficient pressurized gas available to power the actuator to place the apparatus in a safe shut-down mode if the supply of pressurized gas from the source is cut-off.

BRIEF DESCRIPTION OF THE SEVERAL VIEWS OF THE DRAWINGS

The present invention will now be described by way of example with reference to the accompanying drawings.

DETAILED DESCRIPTION OF THE INVENTION

Figure 1:
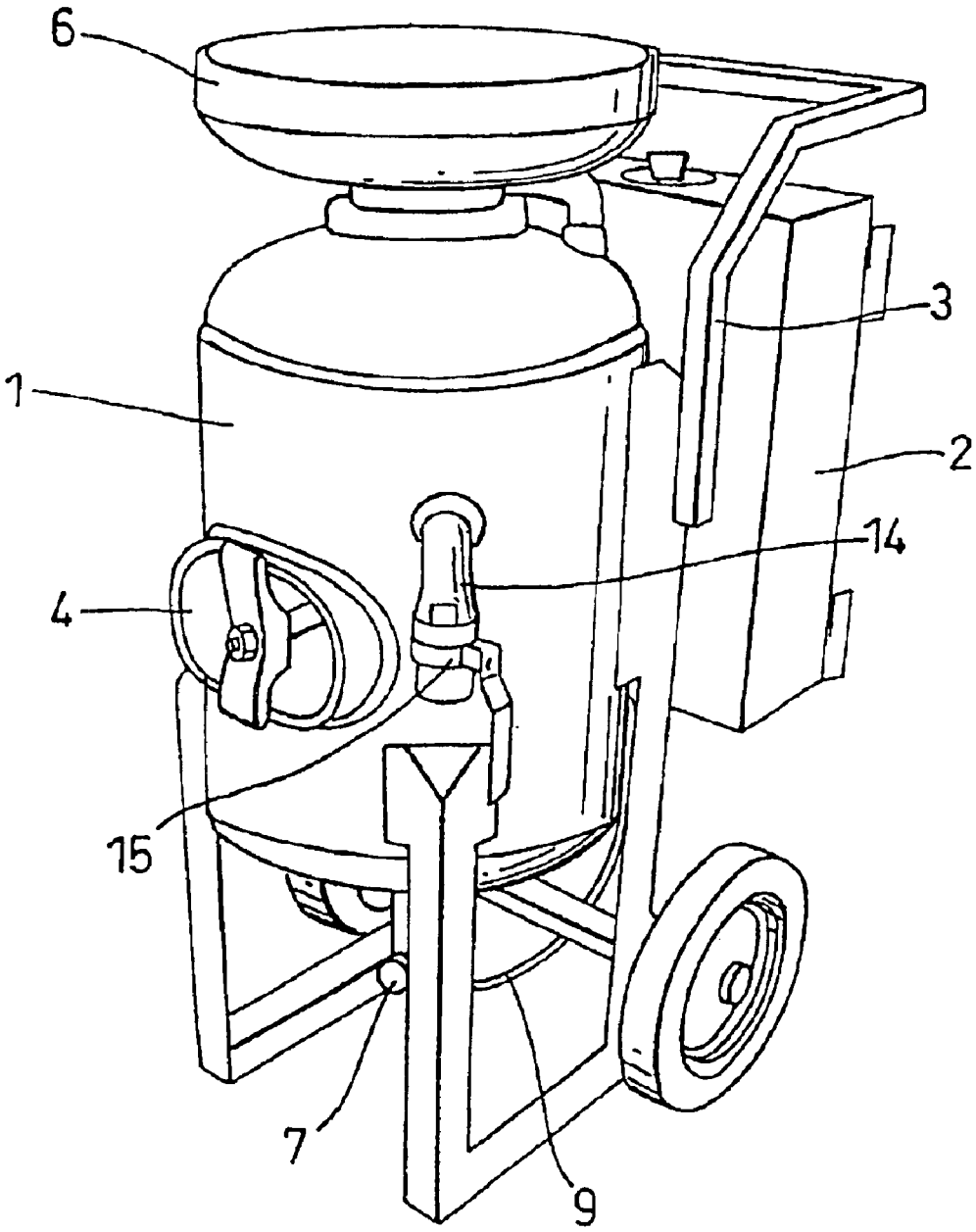
FIG. 1 is a perspective side elevation view of a blasting apparatus according to the present invention.
Figure 2:
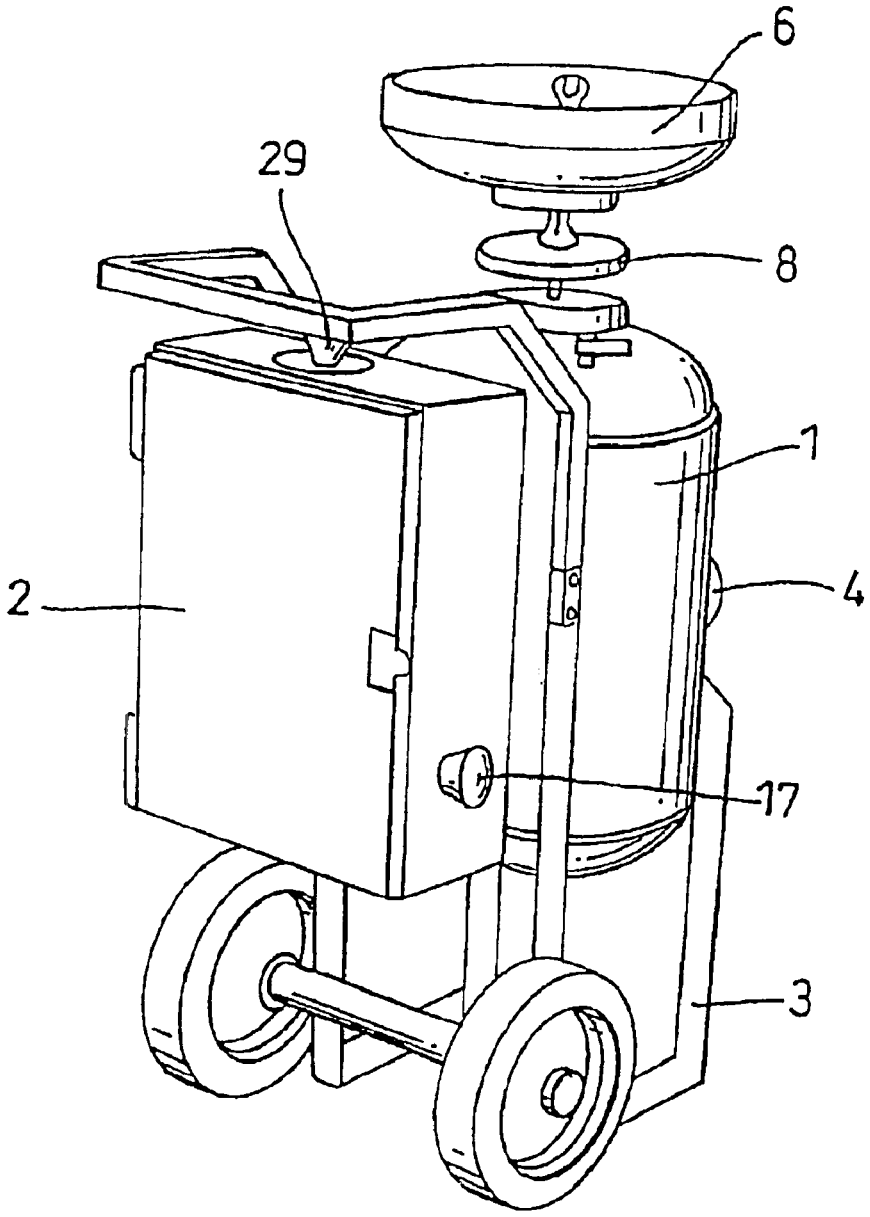
FIG. 2 is a perspective view similar to that of FIG. 1 but from the opposite side of the apparatus and with components at the top of a pressure vessel of the apparatus shown in explosion.

An apparatus according to the invention comprises a pressure vessel 1 to one side of which is attached a control box 2. Preferably, both the vessel 1 and the control box 2 are mounted on framework forming a wheeled trolley 3 with a handle to enable the apparatus to be wheeled close to an object to be blasted.

The pressure vessel 1 is adapted to contain a blasting mixture of a particulate material and a liquid, which is typically water or a water based blasting solution as aforesaid. The vessel 1 is provided with a side inspection plate 4, which during operation of the apparatus is kept shut, and a top blasting medium inlet 5. The inlet 5 is defined centrally at the base of a detachable sieve 6 located at the top of the vessel 1. The vessel also has a bottom outlet 7, which is disposed at a central portion of the bottom of the vessel 1. The inlet 5 can be closed by a seal 8, which is located beneath the sieve 6, in order that the vessel 1 can be internally pressurized. The outlet 7 has no obturating means and communicates directly with the interior of a pipe 9, which therefore effectively forms an extension of the interior of the vessel 1. The pipe 9 communicates the interior of the vessel 1 with a valve block 10 connected into and thereby forming a part of a main air flow conduit 11 through the control box 2, as is further described below. The block 10 comprises a housing for a plunger valve 12 which is used to close the end of the pipe 9 and thereby isolate the interior of the vessel 1 from the pressurized air flow through the conduit 11 which is used to entrain the blasting mixture contained within the vessel 1. The shape of the plunger is such that air can flow around it through the conduit when it is both open and closed.

Within the control box 2 is located a pump 13 for pumping liquid from a supply such as the mains water supply into the upper portion of the vessel 1 via a side inlet (not shown) located between the pump 13 and the vessel 1. Approximately halfway up the vessel 1 but below the level of the side inlet is a side outlet 14, which can be closed by a valve 15 and which comprises an overflow for the contents of the vessel 1.

In order to assist in the egress of the blasting mixture out of the vessel 1 through the bottom outlet 7 at the same rate as water is pumped into the upper portion of the vessel 1, the wall of the lower portion of the vessel 1 is shallowly dished. In addition, two jets of the pumping liquid are injected into the outlet 7 via hoses 16 at the commencement of a blasting operating to clear any particulate material which may have settled out of the liquid and which may otherwise block the outlet 7 and generally to assist in flow of the blasting mixture out of the outlet 7 and through the pipe 9. The jets are tapped off from the main liquid output supplied by the pump 13.

Figure 4:
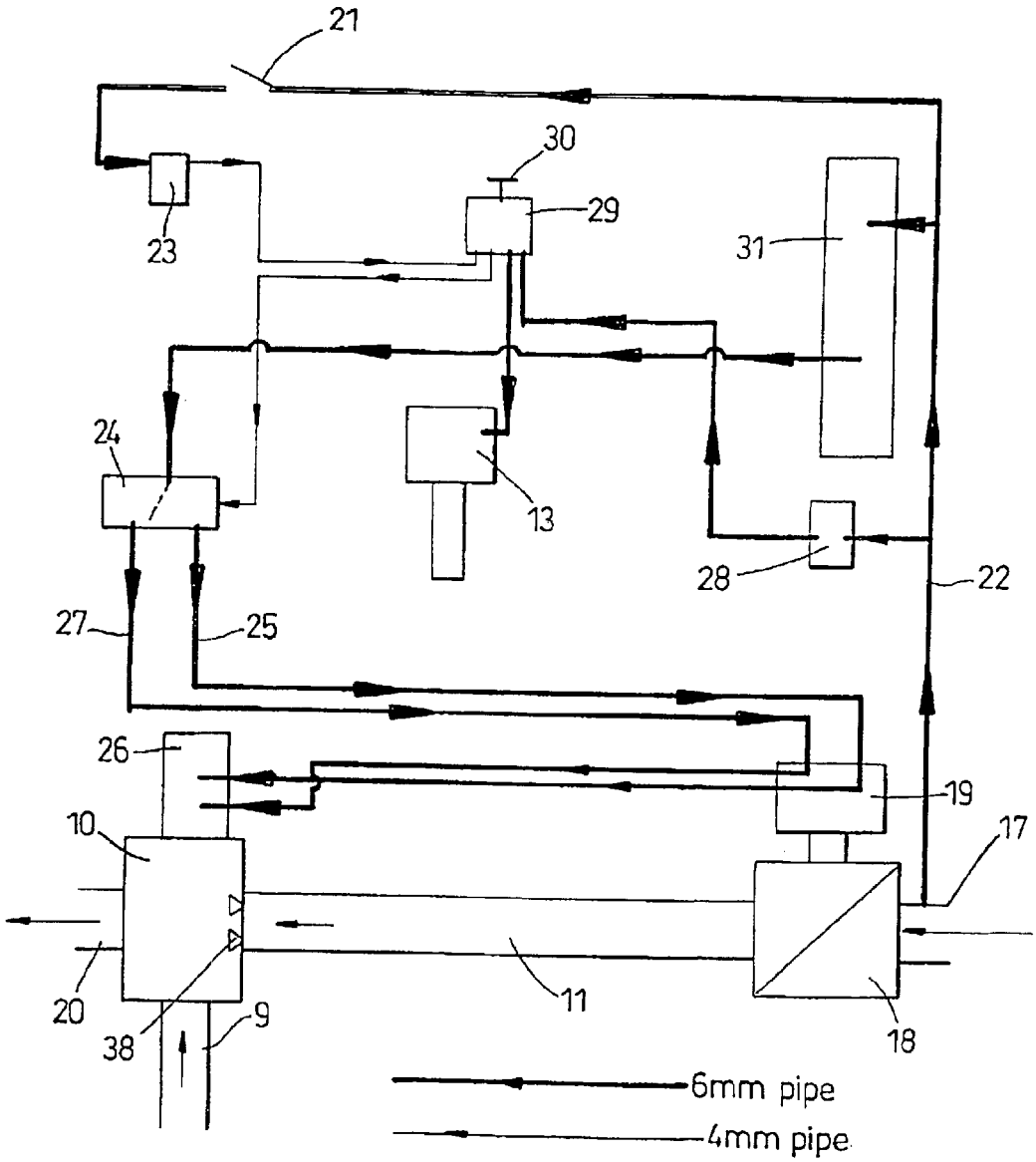
FIG. 4 is a circuit diagram showing pressurized air flow through the apparatus.

The apparatus is provided with pressurized air as its operational or motive fluid from a pressurized air source, such as an air compressor (not shown) via a control circuit, which is shown in detail in FIG. 4. Air under pressure is delivered from the source to a main air inlet 17 of the conduit 11 located at one side of the control box 2 and thence to an inlet port of a butterfly control valve 18 operated by an actuator 19. The valve 18 thus controls the flow of air through the conduit 11.

Figure 3:
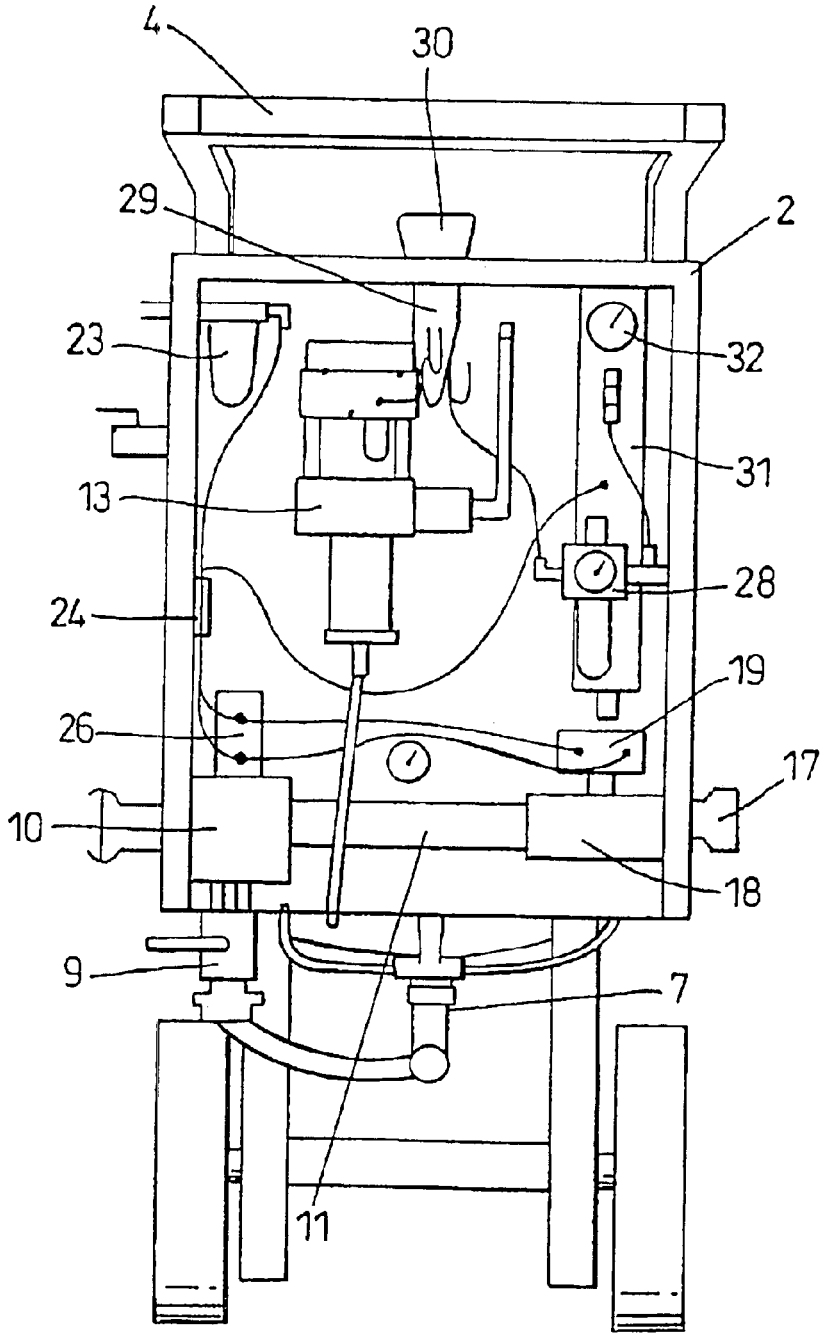
FIG. 3 is a schematic view of the interior of a control box located at one side of the apparatus.

The conduit 11 ends in the block 10 as shown in FIG. 3 and as is described in greater detail below with reference to FIG. 5. When the valve 18 is open, the pressurized air from the source can flow through the conduit 11 and the block 10 and thence through an outlet port 20 into a delivery line (not shown) connected thereto. The delivery line typically comprises a flexible hose with a blasting nozzle (not shown) at its end. The flow of pressurized air in which the blasting mixture has been entrained along the delivery line and out through the nozzle is controlled by an operative using a deadman's handle 21. The handle 21 is preferably connected to the blasting nozzle for the sake of convenience but could be located elsewhere such as attached to the operative's body. The use of the deadman's handle 21 to control the blasting jet enables the blasting operation to be conducted in a fail-safe manner.

The deadman's handle 21 is separately supplied with its own small supply of pressurized air via an air line 22 that is tapped off from the conduit 11 immediately downstream of the inlet 17 and upstream of the control valve 18. It is operationally linked to the control valve 18 and the plunger valve 12 via an air filter 23, which removes stray particulate from the returning air, and a spool valve 24, both of which are located within the control box 2. When the operator wishes to commence a blasting operation, he squeezes a spring-loaded trigger (not shown) in the handle 21 so that pressurized air is permitted to flow through the handle 21 to the spool valve 24, which is thereby operated to permit air to flow through an air line 25 to the actuator 19 of the control valve 18 and an actuator 26 of the plunger valve 12 to cause both valves 12 and 18 to open. However if, for any reason, the operator relaxes his grip on the trigger of the handle 21, the air flow to the spool valve 24 is cut-off. The spool valve 24 then operates, as described below, to cause air flow through a second air line 27 to the actuators 19 and 26 to cause the control valve 18 and the plunger valve 12 to close, thus cutting off the air flow to the delivery line and halting the blasting operation.

The air line 22 also supplies pressurized air to power the pump 13 via an air pressure regulator 28 and an emergency stop arrangement 29. The regulator 28 controls the air supply to the pump 13, preferably so that the pump 13 is regulated with a ⅓ pressure reduction. Hence, a typical 4 bar air pressure supply will produce a 12 bar water pressure.

The emergency stop arrangement 29 includes a button 30 provided on top of the control box 2 which can be struck in an emergency in order that the supply of pressurized air to the pump 13 can be cut off by venting it to the atmosphere. Operation of the pump 13 is thereby immediately halted. The arrangement 29 is also interposed between the air filter 23 and the spool valve 24 and on operation acts to cut-off the supply of air returning from the deadman's handle 21 to the spool valve 24. This has the same effect as release of the deadman's handle 21 by the operative and causes the valves 12 and 18 to close thereby shutting off the air supply to the delivery line to halt the blasting operation.

Pressurized air is also supplied from the air line 22 to an air reservoir 31 by way of a non-return valve (not shown). Air flow into the reservoir 31 from the air line 22 occurs until the pressure in the reservoir 31, as indicated by a pressure gauge 32, balances that within the air line 22. The air reservoir 31 is provided as a safety feature of the apparatus and is linked to the spool valve 24 by an air line 33, the pressure in which is controlled so that normally the spool valve is operated to permit air flow through the line 25 keep the valves 12 and 18 open. However, if there is a failure in the supply of pressurized air from the source, for example if the supply hose is cut or the air compressor fails, the supply of air to the spool valve 24 from the deadman's handle 21 will fail. The connection of the air reservoir 31 to the spool valve 24 is set up such that if this occurs, the spool valve operates to cause pressurized air to flow from the reservoir 31 through the valve 24 down the line 27 to cause the main valve 18 and the plunger valve 12 to close. It will be appreciated that this also occurs when the deadman's handle 21 is released by the operative or the emergency stop arrangement 29 is activated. However, in both the latter cases, the reservoir 31 is immediately replenished with air from the line 22, whereas in the first case when there is an air supply failure, the reservoir 31 ensures that there is sufficient pressurized air available to place the apparatus in a safe shut-down mode. It will be appreciated that in these circumstances, when the apparatus is re-started the valves 12 and 18 can only be opened by operation of the deadman's handle 21 acting on the spool valve 24 after the reservoir 31 has been replenished.

Turning now to the block 10, as previously described this comprises a housing for the plunger valve 12 which is used to open and to close the pipe 9 and thereby permit or prevent the abrasive blasting medium contained with the vessel from the entrained into the pressurized air flow passing through the block 10.

Figure 5:
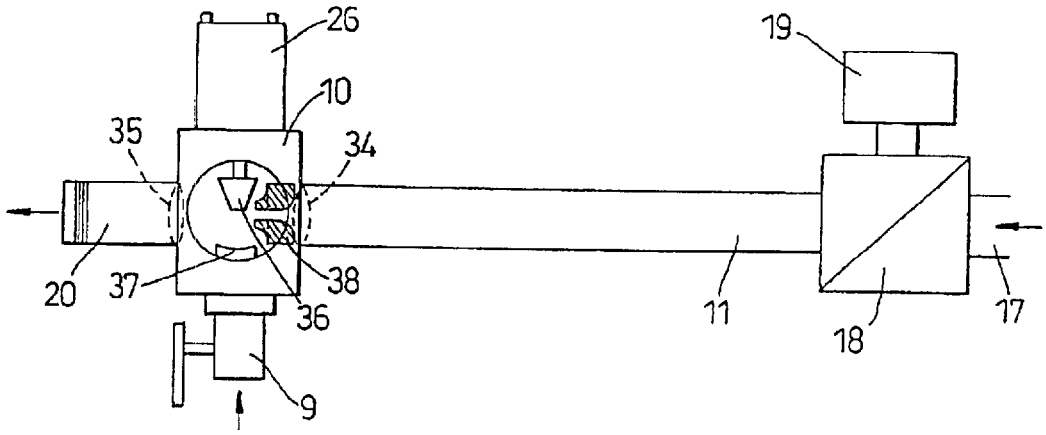
FIG. 5 is an enlarged sectional view in partial cross-section of an air flow conduit located at the lower portion of the control box.

With particular reference to FIG. 5, the block 10 defines an air inlet 34 and an air outlet 35 located respectively directly opposite one another on opposite sides of the block 10. It is through the inlet 34 and the outlet 35 that the pressurized air can enter and exit from the block 10. The valve 12 is located vertically within the block with a valve member 36 disposed so that it can open and close a valve opening 37 defined on the lowermost side of the block 10 over which the air flow through the block passes. The actuator 26 for the valve 12 is mounted above the block 10. The valve opening 37 is formed at the end of the pipe 9 and thereby effectively forms a main outlet from the vessel 1 for the blasting medium as the pipe 9 is connected directly to the interior of the vessel 1 via the bottom outlet 7.

The inlet 34 is fashioned into a venturi 38, which increases the velocity of the pressurized air as it passes over the valve opening 37. This in turn significantly increases the quantity of particulate blasting medium entrained by the air and thereby increases the ratio of abrasive to blasting liquid content, thus reducing the large quantities of liquid waste which results from a blasting operation. It has also been found that the blasting jet issuing from the blasting nozzle is made more uniform and smooth in nature than conventional apparatus.

In use, the apparatus must be set up so that the pump 13 is supplied with a continuous supply of blasting liquid and the air inlet 17 is connected to a source of pressurized air.

Prior to commencing a blasting operation, the vessel 1 must be filled with a blasting medium. The valve 15 is opened and the vessel 1 is filled with water through the top opening 5 until the water starts to overflow from the vessel 1 through the side outlet 14. It will be appreciated that the vessel 1 is now approximately half-full of water. The dry abrasive to be used in the blasting operation is then poured into the vessel 1 through the sieve 6, which prevents any clumps of abrasive or large foreign bodies from entering the vessel 1. Typically, around 75 kilos of abrasive are poured into the vessel 1. This will displace an equal volume of water from the vessel through the side outlet 14. The valve 15 is then closed and the vessel 1 is topped up with water 1 so that all air is expelled therefrom. The valve seal 8 is then used to close the top inlet 5.

The air supply to the inlet 17 can then be switched on and the water pump 13 set to pump up to 1 liter of water per minute into the vessel 1, as determined by a dosing valve (not shown) attached thereto, to control the rate of supply of blasting medium from the vessel 1 to the supply line as desired. Typically between one quarter and one half a liter of water per minute is required. Water is also injected into the outlet 7 via hoses 16 to clear any particulate material which may have settled out and be blocking the conduit 9 Once the air supply has been switched on, the air reservoir 31 fills and the deadman's handle 21 is supplied with a pressurized air flow via the air line 22. The operative can then commence a blasting operation when desired by squeezing the trigger of the handle 21. As described above, this permits air to flow to the spool valve 24, which operates to permit air to flow through the air line 25 to the actuator 19 of the control valve 18 and the actuator 26 of the plunger valve 12 and to cause both valves 12 and 18 to be opened.

Air is now permitted to blast through the conduit 11 and the block 10 over the top of the open valve opening 37. As a result, the air entrains the liquid-coated particulate blasting medium which is supplied to the block 10 under pressure along the conduit 9 from the vessel 1. As described above, the venturi 38 at the inlet 34 greatly increases the quantity of abrasive entrained relative to the liquid so that the blasting jet issuing from the nozzle at the end of the delivery line is substantially dry and contains an even mix of pressurized air and blasting medium. In addition, the shallow dished shape of the lower portion of the vessel 1 assists in ensuring that as much liquid-coated particulate medium as is possible can flow through the pipe 9 under pressure from the water being pumped into the vessel 1 by the pump 13. As each particle of the particulate blasting medium is coated with a film of liquid, this has a beneficial effect on the blasting process as the momentum of each coated particle blasted from the nozzle is thereby increased and results in a more efficient cleaning action.

The operative can continue blasting using the deadman's handle 21 to control the flow of air and blasting media along the delivery line until the supply of particulate medium in the vessel 1 has been used. When it is desired to stop blasting, the operative releases the handle 21, which cuts off its supply of air to the spool valve 24 which then operates to permit air from the reservoir 31 to flow down the line 27 to cause the main valve 18 and the plunger valve 12 to close. Blasting is then stopped.

As previously explained, should an emergency arise requiring the emergency stop button 30 to be depressed or should the supply of pressurized air fail, then the spool valve 24 is also operated to cause air from the reservoir 31 to flow down the line 27 to cause the main valve 18 and the plunger valve 12 to close and thereby stop the blasting operation.

The blasting apparatus can be used with any suitable blasting medium, for example sand; grit-like materials such as garnets, or olivine sands; sodium carbonate; calcium carbonate; calcium magnesium carbonate; calcium oxide; calcium bicarbonate; calcium magnesium carbonate; magnesium oxide; magnesium sulphate; and soda ash as well as small glass beads. The inclusion of the venturi 38 in the valve block 10 has been found to increase by up to four fold the quantity of such blasting media entrained by the pressurized air, which greatly increases the efficiency and efficacy of the blasting operation.

What is claimed is:

1. A blasting apparatus comprising:

a pressure vessel adapted to contain a particulate blasting medium and a liquid and being comprised of an inlet and a bottom outlet;

a conduit along which an entraining pressurized gas can be fed from a pressurizing gas source and with which the interior of the vessel communicates via an opening in the conduit connected to the outlet, the flow of pressurized fluid through the conduit entraining the contents of the vessel for dispersal into the fluid flow for blasting through a delivery line connected to the conduit;

a pressurizing means to pump liquid from a liquid source into the vessel behind its contents in terms of its contents' outflow from the vessel through the bottom outlet; and valve means to control the flow of pressurized gas along the conduit; wherein a venturi is located in the conduit immediately upstream of the opening connected to the bottom outlet of the vessel so that the velocity of the pressurized gas is increased as it passes over the opening thereby to increase the quantity of particulate blasting medium entrained by the gas.

2. An apparatus as claimed in claim 1, wherein said outlet from the pressure vessel communicates directly with the delivery line via a pipe which terminates in the opening.

3. An apparatus as claimed in claim 1, wherein the opening and the venturi respectively comprise inlet ports into a block which forms a part of the conduit, the block defining an outlet for the flow of pressurized gas and entrained media in a side directly opposite the venturi.

4. An apparatus as claimed in claim 3, wherein said opening is defined by the lowermost side of the block.

5. An apparatus as claimed in claim 1, wherein said opening comprises a valve opening which can be obturated by a valve member to close off the supply of particulate blasting medium and liquid from the vessel into the conduit.

6. An apparatus as claimed in claim 5, wherein the block houses the valve member.

7. An apparatus as claimed in claim 1, wherein said valve member comprises a plunger around which pressurized gas in the conduit can flow.

8. An apparatus as claimed in claim 1, further comprising means are provided to inject liquid into the pipe to clear any blockage therefrom.

9. An apparatus as claimed in claim 1, wherein the wall of the lower portion of the vessel defines a shallow dish to encourage flow of the particulate material through the bottom outlet.

10. An apparatus as claimed in claim 1, wherein said valve means comprises an actuator which is powered by the pressurizing gas.

11. An apparatus as claimed in claim 10, further comprising: a gas reservoir to ensure that there is sufficient pressurized gas available to power the actuator to place the apparatus in a safe shut-down mode if the supply of pressurized gas from the source is cut-off.

* * * * *